US007470848B2

(12) United States Patent
Lin et al.

(10) Patent No.: US 7,470,848 B2
(45) Date of Patent: Dec. 30, 2008

(54) STRUCTURE AND METHOD FOR PLAYING MIDI MESSAGES AND MULTI-MEDIA APPARATUS USING THE SAME

(75) Inventors: Chi-Chang Lin, Taichung (TW); Tze-Ying Chang, Yonghe (TW)

(73) Assignee: Sunplus Technology Co., Ltd., Hsinchu (TW)

( * ) Notice: Subject to any disclaimer, the term of this patent is extended or adjusted under 35 U.S.C. 154(b) by 354 days.

(21) Appl. No.: 11/334,159

(22) Filed: Jan. 17, 2006

(65) Prior Publication Data

US 2007/0039451 A1 Feb. 22, 2007

(30) Foreign Application Priority Data

Aug. 18, 2005 (TW) ..... 94128160 A

(51) Int. Cl.
*G10H 7/02* (2006.01)

(52) U.S. Cl. ..... 84/604; 84/602

(58) Field of Classification Search ..... 84/600–602, 84/604–607

See application file for complete search history.

(56) References Cited

U.S. PATENT DOCUMENTS 4,922,794 A * 5/1990 Shibukawa ..... 84/601
5,129,302 A * 7/1992 Nishikawa et al. ..... 84/601
5,198,603 A * 3/1993 Nishikawa et al. ..... 84/601
5,292,997 A * 3/1994 Kato et al. ..... 84/627
5,463,183 A * 10/1995 Konno ..... 84/604
5,652,797 A * 7/1997 Okamura et al. ..... 381/61
6,473,847 B1 * 10/2002 Kamiya ..... 711/171
6,525,256 B2 * 2/2003 Boudet et al. ..... 84/645
6,570,082 B2 * 5/2003 Mukaino et al. ..... 84/622
6,852,918 B2 * 2/2005 Kondo et al. ..... 84/637
6,919,502 B1 * 7/2005 Yamamoto ..... 84/622
6,999,752 B2 * 2/2006 Fukaya ..... 455/412.1
2001/0045155 A1 * 11/2001 Boudet et al. ..... 84/645
2002/0134222 A1 * 9/2002 Tamura ..... 84/622
2004/0267791 A1 * 12/2004 Sunako ..... 707/100
2005/0188819 A1 * 9/2005 Lin et al. ..... 84/603

* cited by examiner

*Primary Examiner*—David S. Warren
(74) *Attorney, Agent, or Firm*—J.C. Patetns

(57) ABSTRACT

A structure for playing MIDI messages including a main-control element, a buffer memory, a MIDI synthesizer, and a pre-processor is provided. The main-control element receives tone colors and the MIDI messages, and loads at least part of the tone colors to the buffer memory. The main-control element transmits the MIDI messages to the pre-processor. The pre-processor coupled to the main-control element and the buffer memory, is used for analyzing the MIDI messages. In addition, the pre-processor dynamically determines at least part of the tone colors to be saved in the buffer memory based on the capacity of the buffer memory.

18 Claims, 6 Drawing Sheets

STRUCTURE AND METHOD FOR PLAYING MIDI MESSAGES AND MULTI-MEDIA APPARATUS USING THE SAME

CROSS-REFERENCE TO RELATED APPLICATION

This application claims the priority benefit of Taiwan application serial no. 94128160, filed on Aug. 18, 2005. All disclosure of the Taiwan application is incorporated herein by reference.

BACKGROUND OF THE INVENTION

1. Field of Invention

The present invention relates to a structure for multi-media. More particularly, the present invention relates to a structure for playing musical instrument digital interface (MIDI thereinafter) messages.

2. Description of Related Art

MIDI is the acronym of Musical Instrument Digital Interface, which is a protocol used for exchanging musical information among music synthesizers, musical instruments, and computers. Since the beginning of 80s, MIDI has been widely accepted and adopted by musicians and composers. MIDI is a standard language used by musical instruments and computers. It is a set of commands which instructs what musical instruments (i.e. MIDI equipments) should do and how to do it, for example, playing musical notes, raising volume, and producing sound effects, etc. MIDI is neither audio signal nor sound that is transmitted over MIDI cable, but a command sent to MIDI equipments or other apparatuses for playing a sound or executing certain action.

MIDI standard is popular mostly because of the following advantages:

1. The files generated are smaller, because MIDI files are commands rather than audio waveforms.
2. Editing is easier because editing commands is easier than editing audio waveforms.
3. It may be used as background music because MIDI music may be played along with other media such as digital video, graphics, animation, audio etc, to enhance the effect of the performance.

FIG. 1 is a block diagram illustrating a conventional structure for playing MIDI messages. Referring to FIG. 1, in the conventional structure 100, the main-control element 101 loads all the tone colors from the wavetables 105 into the memory 107 in advance, then transmits the sequence data 103 to the MIDI synthesizer 109. According to the sequence data 103, the MIDI synthesizer 109 then reads the required tone colors from the memory 107 and synthesizes them into sound, and sends the synthesized sound to the output device 111. The sequence data 103 is MIDI messages. The wavetables 105 is stored in a low-cost and low access speed memory apparatus.

Since the tone colors of wavetables are directly loaded into the buffer memory for synthesis in the conventional structure, the capacity of the buffer memory is a very important for the conventional technology. A large capacity buffer memory is required if the MIDI messages played by a conventional structure with many tone colors. It is not only increases the manufacturing cost, but also limits the hardware extendibility of the conventional structure. The buffer memory needs to be replaced if the volume of tone colors required by the play MIDI messages is greater than the storage capacity of the buffer memory.

SUMMARY OF THE INVENTION

Accordingly, the present invention is directed to provide a structure which has better hardware flexibility and is applicable to different MIDI messages.

According to another aspect of the present invention, a multi-media apparatus that may play any MIDI messages without a large buffer memory is provided.

According to yet another aspect of the present invention, a method for playing MIDI messages that may play MIDI messages according to the capacity of the buffer memory is provided.

The structure for playing MIDI messages provided by the present invention includes a main-control element, a buffer memory, a MIDI synthesizer and a pre-processor. Wherein, the main-control element receives a plurality of tone colors and at least a MIDI message. The pre-processor is coupled to the main-control element and the buffer memory to analyze the MIDI messages and to determine how to load the tone colors into the buffer memory according to the capacity of the buffer memory. The MIDI synthesizer may synthesize the data stored in the buffer memory into audio signals according to the MIDI messages.

According to another aspect of the present invention, a multi-media apparatus including a storage apparatus, a main-control element, a buffer memory, a MIDI synthesizer, and a pre-processor is provided. Wherein, the storage apparatus is used for storing at least a MIDI message and a plurality of tone colors. The main-control element reads the tone colors and the MIDI messages from the storage apparatus and transmits them to the pre-processor. The pre-processor, coupled to the main-control element and the buffer memory, is used for analyzing the MIDI messages and determining how to load the tone colors into the buffer memory according to the capacity of the buffer memory. The MIDI synthesizer may synthesize the data stored in the buffer memory into audio signals according to the MIDI messages.

In the embodiments of the present invention, the aforementioned storage apparatus may further store video data, and the multi-media apparatus provided by the present invention may further include a demultiplexer and a decoder. Wherein the input of the demultiplexer is coupled to the main-control element, and the first output thereof is coupled to the pre-processor to transmit the MIDI messages to the pre-processor, and the second output thereof is coupled to the decoder so that the decoder may receive video data for decoding through the demultiplexer.

According to another aspect of the present invention, a MIDI message playing method adapted to the capacity of the buffer memory is provided for generating audio signals according to the MIDI messages, and the steps of the present invention are described below. First, receive a MIDI file, which contains MIDI messages, and analyze the MIDI messages to produce an analysis result. Load all the tone colors of wavetables into a storage area if the size of the storage area is large enough to store all the wavetables. Load the tone colors required for processing the MIDI messages into the storage area according to the analysis result, if the size of the storage area is not large enough for storing all the wavetables but enough for storing all the required tone colors for processing the MIDI messages. And load the tone colors required currently for processing the MIDI messages into the storage area in real time according to the analysis result, if the capacity of the storage area is not large enough to store all the wavetables or to store all the required tone colors. After that, generate audio signals according to the MIDI messages and using the wavetables (or tone colors) in the storage area.

According to an exemplary embodiment of the present invention, if the capacity of the storage area is not large enough to store all the wavetables or to store all the required tone colors for processing the MIDI messages, the storage area is divided into several sub-areas according to the maximum volume of the tone colors required for synthesizing the MIDI messages. Next, the tone colors required currently are loaded for processing the MIDI messages into these sub-areas respectively. Those tone colors without current need are removed from the storage area when there is no more sub-area to store other tone colors that will be used next.

According to another aspect of the present invention, a MIDI message playing method applicable to processing sequence data is provided, which includes dividing a storage area into a first sub-area and a second sub-area first, then dividing the content of the sequence data into several sub-sets in order in advance, and the total size of the required tone colors of each sub-set is not greater than the capacity of the first sub-area or the capacity of the second sub-area. First, load the tone colors required for a sub-set of sequence data into the first sub-area, then read the required tone colors from the first sub-area and synthesize them into audio signals according to the sub-set of sequence data corresponding to the tone colors in the first sub-area. Load the required tone colors of the next sub-set into the second sub-area in advance while using the tone colors in the first sub-area to synthesize into audio signals, so that audio signals are synthesized according to the tone colors of the subset in the second sub-area after the process of tone colors in the first sub-area is completed.

Similarly, load the required tone colors of the other next sub-set of data sequence into the first sub-area in advance when synthesizing the audio signals by using the tone colors in the second sub-area, so that audio signals are synthesized according to the tone colors of the subset in the first sub-area after the process of tone colors in the second sub-area is completed. Repeating the step of loading the tone colors of each of the sub-sets into the first sub-area and the second sub-area until the tone colors of the sub-sets are complete.

In summary, the present invention includes at least the following advantages:

1. The present invention is not restricted by the capacity of the buffer memory because the pre-processor analyzes the MIDI messages before loading tone colors of wavetables into the buffer memory in the structure provided by the present invention.
2. The present invention has better hardware flexibility and can reduce hardware cost with buffer memory of lower capacity by the aforementioned structure is used in the multi-media apparatus.
3. The present invention is applicable to different MIDI messages because the tone colors are loaded according to the capacity of the storage area in the MIDI message playing method provided by the present invention.

In order to make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

MIDI data is the definition of a set of musical notes rather than actual musical audio. The content of a MIDI file consists of MIDI messages. An MIDI message consists of 1 to 8 status bits and generally followed by 2 data bytes. In the status bits, the most significant bit is set to "1", and the following 3 bits are used for indicating which type of message this MIDI message is. The remaining 4 bits may be used for indicating which channel this MIDI message belongs to, and 4 bits can indicate 16 possible channels. MIDI messages may be categorized into 2 types, i.e. channel messages and system messages.

There are many ways to generate MIDI sound, and the most common methods are: Frequency Modulation (FM) Synthesis and Wavetable Synthesis. It's very difficult to produce various sound effects using the Frequency Modulation Synthesis because it's almost impossible to generate some sound effects. Thus, the Wavetable Synthesis has become the preferred option. Wavetable Synthesis records real sounds in digital format and change the playing speed and then change the tone periods to generate musical notes of various musical scales when Wavetable Synthesis are being played. Generally, there are various tone colors in the wavetable.

Figure 1:
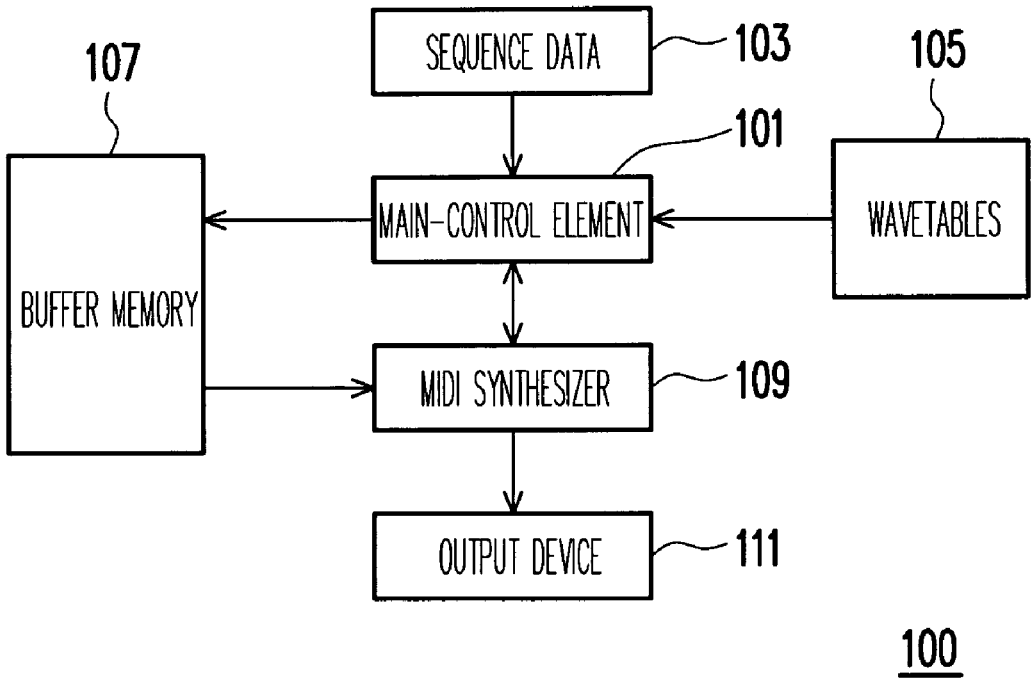
FIG. 1 (PRIOR ART)
FIG. 1 is a block diagram illustrating a conventional structure for playing MIDI messages.
Figure 2:
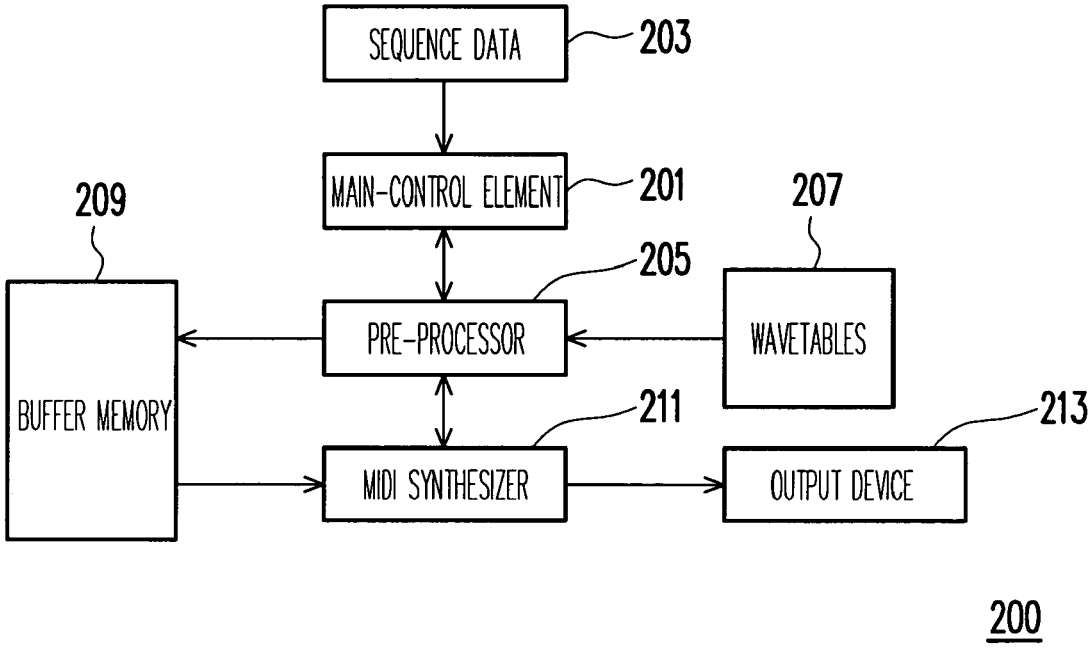
FIG. 2 is a block diagram illustrating a structure for playing MIDI messages according to an embodiment of the present invention.

FIG. 2 is a block diagram illustrating a structure for playing MIDI messages according to the present invention. The main-control element 201 reads the sequence data 203 and sends it to the pre-processor 205. After analyzing the sequence data 203, the pre-processor 205 reads the wavetables 207 and saves the tone colors into the memory 209, and transmits the sequence data 203 to the MIDI synthesizer 211. The MIDI synthesizer reads the required tone colors from the memory 209 to synthesize them into audio signals according to the sequence data 203.

The main-control element 201 sends the sequence data (MIDI messages) 203 to the pre-processor 205 after receiving the sequence data (MIDI messages) 203. The pre-processor 205 analyzes the sequence data (MIDI messages) 203 and transmits at least part of the tone colors to the buffer memory 209 to be registered according to the capacity of the buffer memory 209. In the present embodiment, the buffer memory 209 is, for example, dynamic random access memory (DRAM), synchronous dynamic random access memory (SDRAM), or flash memory etc. The pre-processor 205 transmits the sequence data (MIDI message) 203 to the MIDI synthesizer 211 after transmitting the wavetables to the buffer memory 209 to be registered, and the MIDI synthesizer 211 generates synthesized sound effects according to the data in the buffer memory 209.

Figure 3:
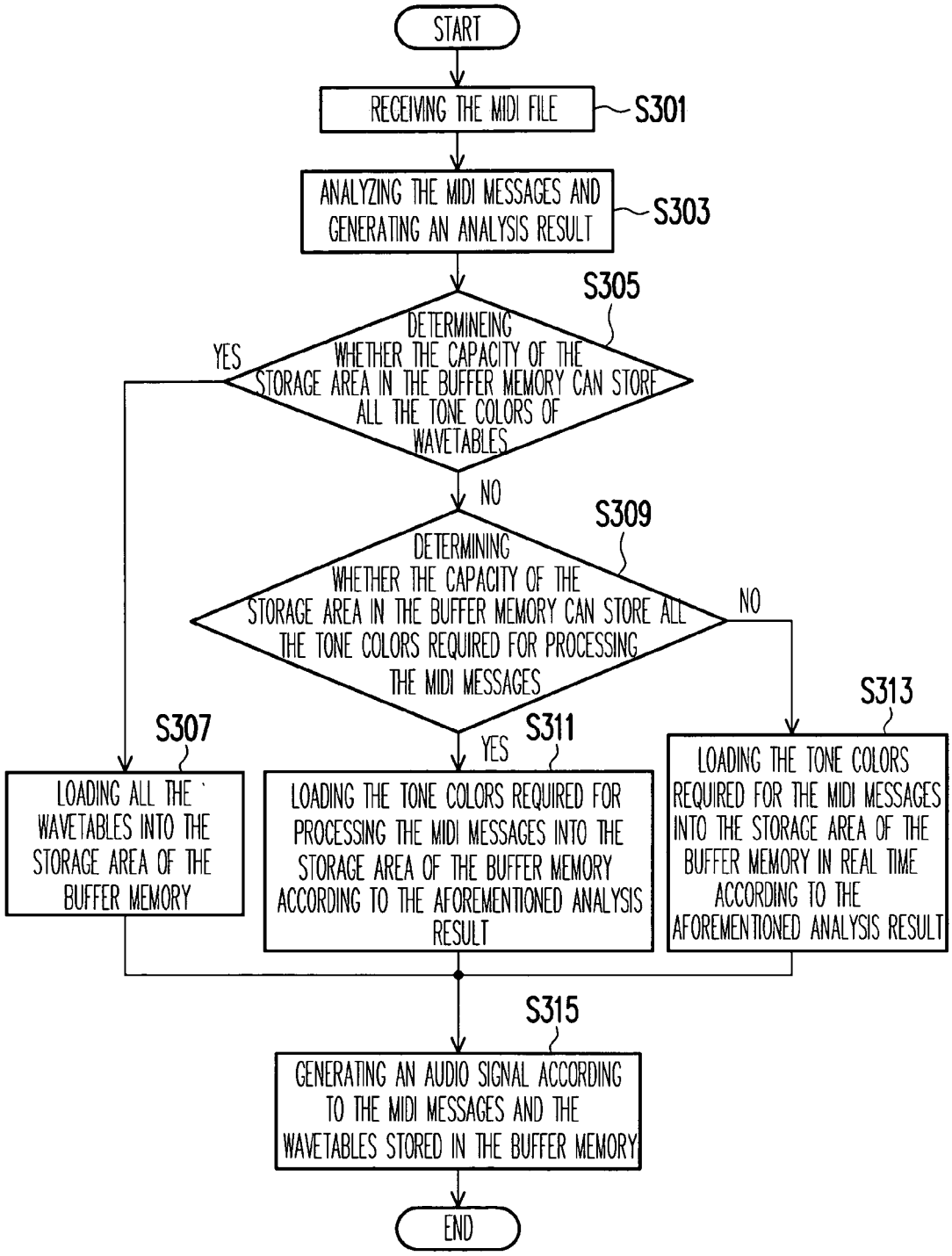
FIG. 3 is a flowchart illustrating a method for playing MIDI messages according to an embodiment of the present invention.

FIG. 3 is a flowchart illustrating a method for playing MIDI messages according to an embodiment of the present invention. Referring to both FIGS. 2 and 3, the main-control element 201 transmits the MIDI message 203 to the pre-processor 205 after receiving the MIDI message 203, as described in step S301. And the pre-processor 205 performs step S303, which is, analyzing the MIDI message 203 and generating an analysis result. Here, the pre-processor 205 determines whether the capacity of the storage area in the buffer memory 209 can store all the wavetables in step S305. If the capacity of the storage area in the buffer memory 209 can store all the tone colors of wavetables (i.e. "yes" in step S305), then the pre-processor 205 loads all the wavetables into the storage area of the buffer memory 209 in step S307.

On the other hand, if the pre-processor 205 determines that the capacity of the storage area in the buffer memory 209 cannot store all the wavetables (i.e. "no" in step S305), then the pre-processor 205 performs step S309, which is, determining again whether the capacity of the storage area in the buffer memory 209 can store the tone colors required for processing the MIDI message. Assuming that the MIDI message processed by the present invention needs ten tone colors among all the wavetables, the pre-processor 205 would determine whether the storage capacity of the buffer memory 209 could store these ten tone colors.

If the capacity of the buffer memory 209 is determined to be enough for storing all the tone colors required for processing the sequence data (MIDI message) 203 (i.e. "yes" in step S309), then the pre-processor 205 loads the tone colors required for processing the sequence data (MIDI message) 203 into the storage area of the buffer memory 209 according to the aforementioned analysis result in step S311. On the other hand, if the capacity of the buffer memory 209 is not enough for storing all the wavetables required for processing the sequence data (MIDI message) 203 (i.e. "no" in step S309), then the pre-processor 205 executes step S313, which is, loading the tone colors required for synthesizing according to the sequence data (MIDI messages) 203 into the storage area of the buffer memory 209 in real time according to the aforementioned analysis result. The MIDI synthesizer 211 would generate an audio signal according to the sequence data (MIDI message) 203 and the wavetables stored in the buffer memory 209 in step S315, after the pre-processor 205 loads the wavetables into the buffer memory 209.

Figure 4:
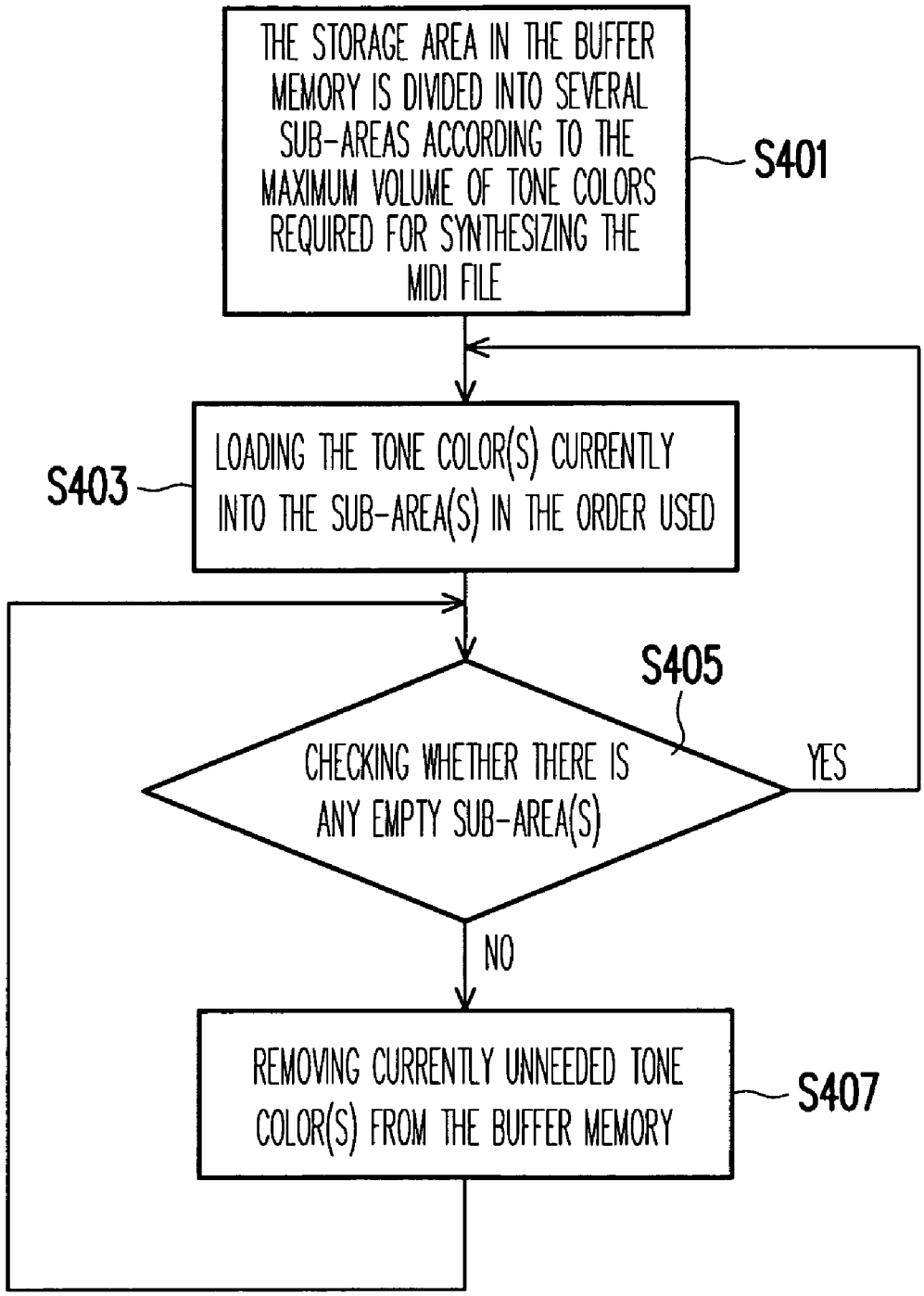
FIG. 4 is a flowchart illustrating the steps of loading the tone colors of wavetables into the buffer memory in real time according to an embodiment of the present invention.

FIG. 4 is a flowchart illustrating the steps of loading the tone colors of wavetables into the buffer memory in real time according to an embodiment of the present invention. Referring to FIGS. 2 and 4, when the pre-processor 205 is to load the tone colors into the buffer memory 209 in real time in step S313 in FIG. 3, the storage area is divided in the buffer memory 209 into a plurality of sub-areas according to the size of the maximum volume of the tone colors required for synthesizing according to the sequence data (MIDI messages) 203, in step S401. For example, there are ten musical instruments in a sequence data (MIDI message) 203, and the tone colors of the piano's wavetables occupy the most space, then the storage area of the buffer memory 209 is divided into a plurality of sub-areas in the units of the volume of tone colors of the piano's wavetables.

Next, the pre-processor 205 loads the tone colors required currently for processing the sequence data (MIDI message) 203 into the sub-areas of the buffer memory 209 respectively in the order used, in step S403. After that the pre-processor 205 transmits this part of the sequence data (MIDI message) 203 to the MIDI synthesizer 211, the MIDI synthesizer 211 may obtain the required tone colors from the buffer memory 209 to synthesize into audio signals. The tone colors in the buffer memory 209 may be deleted after usage. While synthesizing into audio signals, the pre-processor 205 checks constantly whether there is any empty sub-area in the buffer memory 209 for storing another tone color(s), in step S405. If there is still empty sub-area in the buffer memory 209 for storing tone colors (i.e. "yes" in step S405), the step S403 is repeated. And if there is no more empty sub-area in the buffer memory for storing tone colors (i.e. "no" in step S405), then the pre-processor 205 removes those tone colors without current need for processing the sequence data (MIDI messages) 203 from the buffer memory 209 in step S407.

In some other embodiments of the present invention, those unimportant wavetables may be removed from the buffer memory by controlling the Maximum Polyphony.

Figure 5:
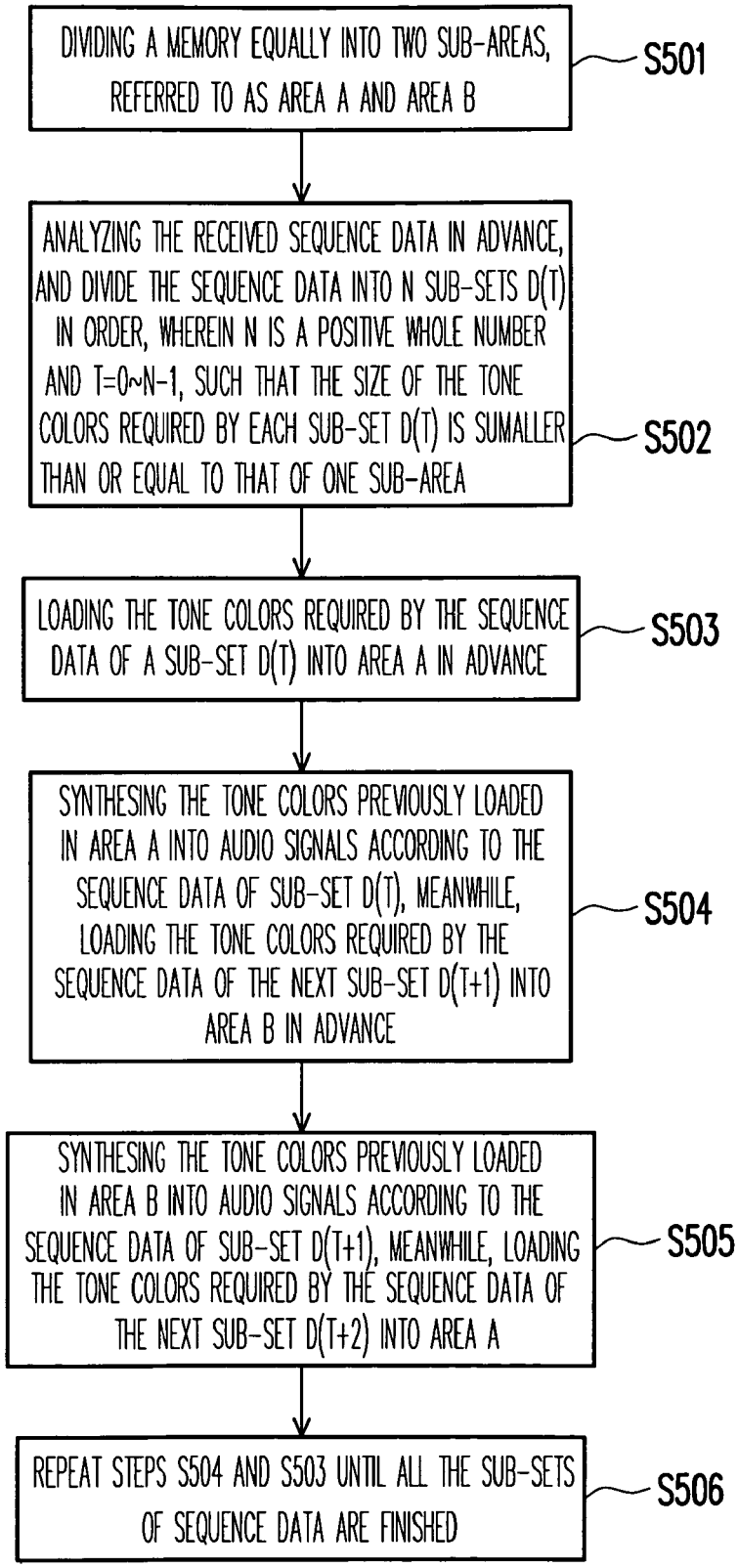
FIG. 5 is a flowchart illustrating the steps of loading the tone colors of wavetables into the buffer memory in real time according to another embodiment of the present invention.

FIG. 5 is a flowchart illustrating the steps of loading the tone colors into the buffer memory in real time according to another embodiment of the present invention that may be used for processing a sequence data, i.e. the aforementioned MIDI message. Referring to FIG. 5, first, in step S501, divide a memory into two sub-areas, referred to as area A and area B respectively. In an exemplary situation, the size of area A, M for example, is equal to the size of area B, and M is a natural number.

Next, analyze the received sequence data in advance, and divide the sequence data into N sub-sets D(t) in order, wherein N is a positive integer and t=0~(N−1). In step S502, the total of the tone colors required by the sequence data of each sub-set D(t) is not greater than M. The present invention goes to step S503, which is, loading the tone colors required by the sequence data of a sub-set D(t) into area A in advance. Then proceed to step S504, when the MIDI synthesizer obtains the required tone colors from area A to synthesize an audio signal according to the sequence data of the sub-set D(t). Meanwhile, the present invention loads the tone colors required by the sequence data of the next sub-set D(t+1) into area B in advance.

Similarly, in step S505, obtain the required tone colors from area B to synthesize an audio signal according to the sequence data of the sub-set D(t+1). Meanwhile, load the tone colors required by the sequence data of the next sub-set D(t+2) into area A. Finally, in step S506, repeat steps S504 and S503 until all the sub-sets of sequence data are processed. Thus, the audio synthesis can be accomplished by loading the tone colors of wavetables dynamically when the memory space is not large enough.

Figure 6:
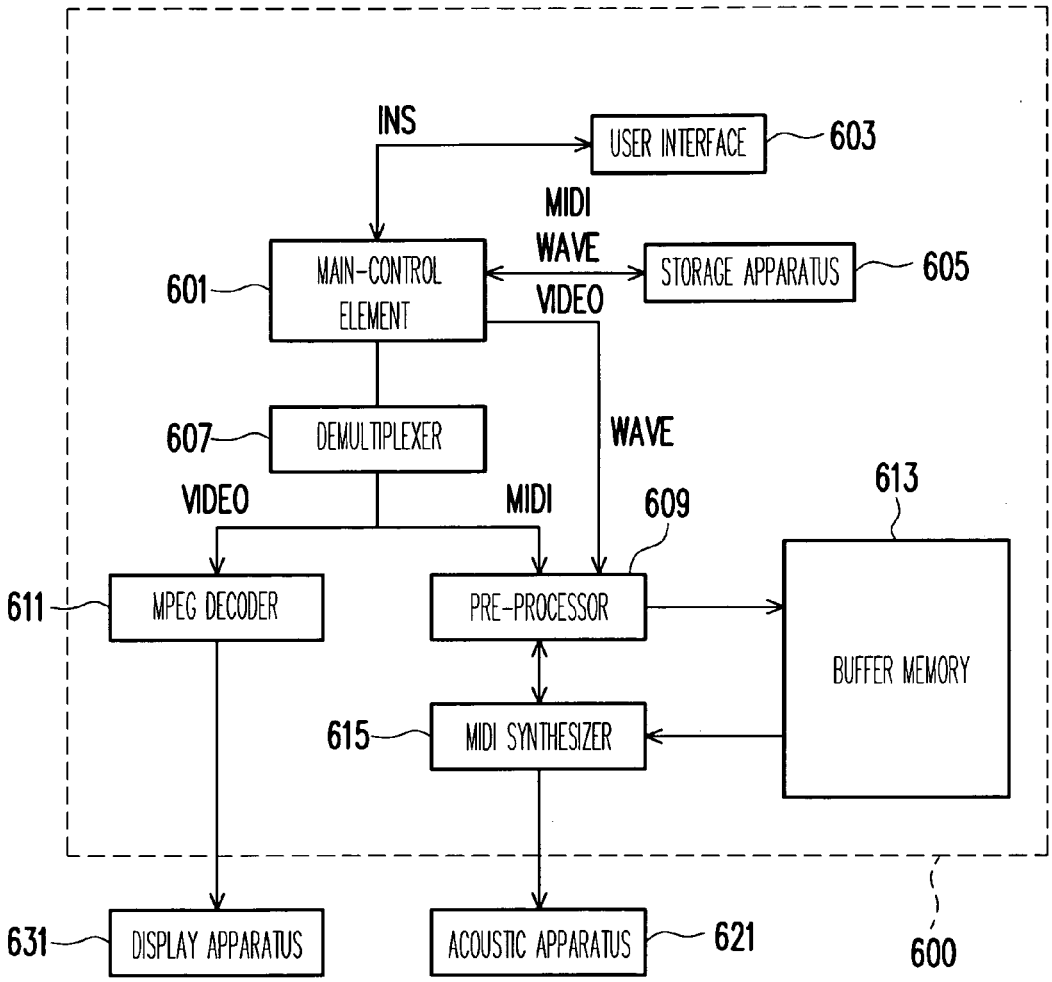
FIG. 6 is a block diagram illustrating a multi-media apparatus according to an embodiment of the present invention.

According to the playing structure in FIG. 2, the present invention also provides a multi-media apparatus as shown in FIG. 6. In the multi-media apparatus 600, a main-control element 601 is disposed, which receives the user input command INS through a user interface 603, and the main-control element 601 extracts files, for example, a MIDI message, a plurality of wavetables, and a video data VIDEO, from the storage apparatus 605 according to the user input command INS. The output of the main-control element 601 is coupled to the pre-processor 609 and a decoder, such as MPEG decoder 611, through the demultiplexer 607. The output of the pre-processor 609 is coupled to the buffer memory 613 and the pre-processor 609 controls the operation of the MIDI synthesizer 615 according to the output of the main-control element 601.

Referring to FIG. 6 again, the main-control element 601 transmits the MIDI message to the pre-processor 609 through the demultiplexer 607 and the video data VIDEO to the MPEG decoder 611 after the main-control element 601 extracts the MIDI message, the wavetables, and the video data VIDEO from the storage apparatus 605. In the present invention, the storage apparatus 605 may be a storage media as a hard disk, a Video CD (VCD), a Digital Versatile Disc (DVD), a memory card, and a flash disk etc.

When the pre-processor 609 receives the MIDI message, it loads at least part of the tone colors into the buffer memory 613 and controls the MIDI synthesizer 615 to synthesize an audio using the tone colors stored in the buffer memory 613 according to the method described in FIGS. 3 and 4. In addition, the output of the MIDI synthesizer 615 is coupled to an acoustic apparatus 621, such as a speaker, to output the synthesized audio through the acoustic apparatus 621.

Moreover, the MPEG decoder 611 decodes the video data VIDEO when receiving the video data VIDEO through the demultiplexer 607, then the MPEG decoder 611 transmits the decoded video data VIDEO to the display apparatus 631 to output it. In the present invention, the display apparatus 631 is, for example, a liquid crystal display or a conventional TV set.

In summary, in the present invention, a pre-processor is disposed to process the MIDI messages in advance, and by using the playing method of the present invention, the volume of the tone colors of wavetables to be loaded is determined according to the capacity of the storage area of the buffer memory. Thus, the present invention has better hardware flexibility and can be applied to process different kinds of MIDI messages.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A structure for playing musical instrument digital interface (MIDI) messages, the structure comprising:

a main-control element for receiving a plurality of tone colors and an MIDI message;

a buffer memory used for storing at least part of the tone colors;

an MIDI synthesizer used for synthesizing the tone colors stored in the buffer memory into an audio signal; and a pre-processor, coupled to the main-control element and the buffer memory, used for analyzing the MIDI message, and saving at least part of the tone colors into the buffer memory according to the capacity of the buffer memory, wherein the pre-processor divides a storage area into a plurality of sub-areas according to the size of the tone colors occupying the largest capacity in the MIDI message, loads the tone colors required currently for processing the MIDI message into the sub-areas respectively, and removes the tone colors without current need from the storage area if there is no more sub-area for storing the tone colors.

2. The MIDI message playing structure as claimed in claim 1, wherein the MIDI synthesizer is further coupled to an acoustic apparatus to play the output of the MIDI synthesizer.

3. The MIDI message playing structure as claimed in claim 2, wherein the acoustic apparatus includes a speaker.

4. A multi-media apparatus, comprising:

a storage apparatus used for storing at least a musical instrument digital interface (MIDI) message and a plurality of tone colors;

a main-control element, coupled to the storage apparatus, used for reading the tone colors and the MIDI message;

a buffer memory used for storing at least part of the tone colors;

an MIDI synthesizer used for synthesizing the tone colors stored in the buffer memory into an audio signal according to the MIDI message;

a pre-processor used for analyzing the MIDI message, and saving at least part of the tone colors into the buffer memory according to the capacity of the buffer memory;

a demultiplexer, an input thereof coupled to the main-control element, and a first output thereof coupled to the pre-processor to transmit the MIDI message to the pre-processor; and a decoder, coupled to the second output of the demultiplexer, used for receiving a video data which is stored in the apparatus for decoding through the demultiplexer.

5. The multi-media apparatus as claimed in claim 4, wherein the main-control element is further coupled to a user interface to receive a user input command through the user interface.

6. The multi-media apparatus as claimed in claim 4, wherein the decoder is also coupled to a display apparatus so that the decoded video data can be transmitted to the display apparatus to be displayed.

7. The multi-media apparatus as claimed in claim 4, wherein the MIDI synthesizer is further coupled to an acoustic apparatus used for playing the output of the MIDI) synthesizer.

8. The multi-media apparatus as claimed in claim 7, wherein the acoustic apparatus is a speaker.

9. The multi-media apparatus as claimed in claim 4, wherein the storage apparatus is one of a Video CD (VCD) and a Digital Versatile Disc (DVD).

10. The multi-media apparatus as claimed in claim 4, wherein the storage apparatus is a hard disk, a memory card, or a flash disk.

11. A method for playing musical instrument digital interface (MIDI) messages, applicable for generating an audio signal using at least part of a plurality of tone colors and the MIDI message, the method comprising:

receiving the MIDI message;

analyzing the MIDI message and generating an analysis result;

loading all the tone colors into a storage area if the capacity of the storage area is large enough to store all the tone colors;

loading the tone colors required for processing the MIDI message into the storage area according to the analysis result if the capacity of the storage area is not large enough for storing all the tone colors but large enough for storing the tone colors required for processing the MIDI message;

loading the tone colors required currently for processing the MIDI message into the storage area in real time according to the analysis result if the capacity of the storage area is not large enough for storing all the tone colors or for storing the tone colors required for processing the MIDI message wherein the storage area is divided into a plurality of sub-areas according to the size of the tone colors occupying the largest capacity in the MIDI message, the tone colors required currently for processing the MIDI message are loaded into the sub-areas respectively, and then the tone colors are removed without current need from the storage area if there is no more sub-area for storing the tone colors; and generating an audio signal according to the MIDI message and the tone colors in the storage area.

12. The MIDI message playing method as claimed in claim 11, wherein the steps of receiving the MIDI message include reading the MIDI message and the tone colors from a Video CD (VCD).

13. The MIDI message playing method as claimed in claim 11, wherein the steps of receiving the MIDI message include reading the MIDI message and the tone colors from a Digital Versatile Disc (DVD).

14. The MIDI message playing method as claimed in claim 11, wherein the step of saving the tone colors into the storage area among the steps of receiving the MIDI message includes writing the wavetables into one of a dynamic random access memory (DRAM), a synchronous dynamic random access memory, and a flash memory.

15. The MIDI message playing method as claimed in claim 11, further including the step of transmitting the audio signal to a speaker to play this synthesized audio signal.

16. A method for playing musical instrument digital interface (MIDI) messages applicable for processing a sequence data, the steps of method including:

dividing a memory area into a first sub-area and a second sub-area;

dividing the content of the sequence data into a plurality of sub-sets in order in advance, and the total of tone colors required by the sub-sets is not larger than the size of the first sub-area or the size of the second sub-area;

loading the tone colors required by one of the sub-sets into the first sub-area;

obtaining the required tone colors from the first sub-area to synthesize an audio signal according to the sub-set of sequence data corresponding to the tone colors in the first sub-area; and loading the next sub-set of tone colors into the second sub-area in advance when using the tone colors in the first sub-area to synthesize an audio signal, so as to obtain the required tone colors from the second sub-area to synthesize the audio signal after a process of the tone colors in the first sub-area is complete.

17. The MIDI message playing method as claimed in claim 16, further including:

loading the next sub-set of tone colors into the first sub-area in advance when combining the audio signal using the tone colors in the second sub-area, so as to obtain the required tone colors from the first sub-area to synthesize the audio signal after the process of the tone colors in the second sub-area is complete; and repeating the step of loading the tone colors of each of the sub-sets into the first sub-area and the second sub-area until the tone colors of the sub-sets are complete.

18. The MIDI message playing method as claimed in claim 16, wherein the size of the first sub-area is equal to the size of the second sub-area.

* * * * *